US008556090B2

(12) United States Patent
Chen

(10) Patent No.: US 8,556,090 B2
(45) Date of Patent: Oct. 15, 2013

(54) STORAGE RACK

(76) Inventor: Fang-Yin Chen, Taichung (TW)

( * ) Notice: Subject to any disclaimer, the term of this patent is extended or adjusted under 35 U.S.C. 154(b) by 0 days.

(21) Appl. No.: 13/275,389

(22) Filed: Oct. 18, 2011

(65) Prior Publication Data

US 2013/0092647 A1 Apr. 18, 2013

(51) Int. Cl.
*A47G 29/00* (2006.01)

(52) U.S. Cl.
USPC ..... 211/85.17; 211/181.1

(58) Field of Classification Search
USPC ..... 211/85.17, 85.15, 85.31, 85.29, 71.01, 211/181.1, 50, 90.03, 106, 119, 133.5; D6/574, 566; 206/425; 248/302, 311.2, 248/311.3, 312, 312.1, 313, 465.1, 107, 248/112, 153, 175, 218.1, 249; 221/45, 46; 224/248, 434; D7/600.1
See application file for complete search history.

(56) References Cited

U.S. PATENT DOCUMENTS

| | | | | | |
|---|---|---|---|---|---|
| 827,559 | A | * | 7/1906 | Oberg | 248/107 |
| 1,378,902 | A | * | 5/1921 | Roehl | 248/302 |
| 1,386,392 | A | * | 8/1921 | Brant | 248/107 |
| 1,715,078 | A | * | 5/1929 | Whyte et al. | 211/50 |
| 1,724,428 | A | * | 8/1929 | Sherman | 221/46 |
| 1,867,969 | A | * | 7/1932 | Fiegel | 248/107 |
| 2,294,151 | A | * | 8/1942 | Wooten, Jr. et al. | 248/217.1 |
| 2,354,859 | A | * | 8/1944 | Godwin | 248/465.1 |
| 2,451,281 | A | * | 10/1948 | Elfner | 248/302 |
| 2,460,906 | A | * | 2/1949 | Schmiedeberg | 248/302 |
| 2,487,094 | A | * | 11/1949 | Brown | 248/518 |
| 2,546,587 | A | * | 3/1951 | Eisenberg | 108/152 |
| 3,115,106 | A | * | 12/1963 | Gersch | 108/64 |
| 3,175,694 | A | * | 3/1965 | Reibold et al. | 211/60.1 |
| 3,591,120 | A | * | 7/1971 | Fietzer et al. | 248/311.3 |
| 3,918,588 | A | * | 11/1975 | Walser et al. | 211/49.1 |
| 3,921,948 | A | * | 11/1975 | Long | 248/220.41 |
| 4,267,997 | A | * | 5/1981 | Meier | 220/491 |
| D273,736 | S | * | 5/1984 | Barry | D6/556 |
| 4,517,761 | A | * | 5/1985 | Bleggi | 43/21.2 |
| 4,971,277 | A | * | 11/1990 | Tedham et al. | 248/175 |
| 6,045,107 | A | * | 4/2000 | Carlson | 248/445 |
| 6,102,218 | A | * | 8/2000 | Alfonso et al. | 211/119 |
| 8,181,922 | B2 | * | 5/2012 | Dennison | 248/175 |

* cited by examiner

*Primary Examiner* — Darnell Jayne
*Assistant Examiner* — Stanton L Krycinski
(74) *Attorney, Agent, or Firm* — Muncy, Geissler, Olds & Lowe, PLLC

(57) ABSTRACT

A storage rack includes a U-shaped top constraint rod, a U-shaped bottom positioning rod, two oblique upper side rods respectively forwardly extended from two distal ends of the U-shaped top constraint rod, two oblique lower side rods respectively backwardly extended from respective bottom ends of the two oblique upper side rods and respectively connected to two distal ends of the U-shaped bottom positioning rod, and a transverse rod transversely connected between the two distal ends of the U-shaped bottom positioning rod.

1 Claim, 4 Drawing Sheets

STORAGE RACK

BACKGROUND OF THE INVENTION

1. Field of the Invention

The present invention relates to storage devices and more particularly, to a simple structure of storage rack, which is inexpensive to manufacture and practical for holding a box or a set of bags stably.

2. Description of the Related Art

Conventionally, people usually use a box to keep cap-like products (such as coffee balls, milk balls, coffee mate balls). The box has a bottom access hole through which a person can pull each individual storage item out of the box. When taking one storage item out of the box, the user must hold the box with one hand and then pull one storage item out of the box with the other hand. Further, when storing bagged products, such as tea bags or coffee bags in a box, the bagged products may be not arranged in a good order for convenient service.

SUMMARY OF THE INVENTION

The present invention has been accomplished under the circumstances in view. It is one object of the present invention to provide a storage rack, which is inexpensive to manufacture and practical for holding a box or a set of bags stably.

To achieve this and other objects of the present invention, a storage rack is made of metal wire rods. The storage rack comprises a U-shaped top constraint rod, a U-shaped bottom positioning rod, two oblique upper side rods respectively forwardly extended from two distal ends of the U-shaped top constraint rod, two oblique lower side rods respectively backwardly extended from respective bottom ends of the two oblique upper side rods and respectively connected to two distal ends of the U-shaped bottom positioning rod, and a transverse rod transversely connected between the two distal ends of the U-shaped bottom positioning rod. Further, the contained angle defined by the oblique upper side rods and the oblique lower side rods can be changed to control the height of the storage rack for different applications.

DETAILED DESCRIPTION OF THE PREFERRED EMBODIMENT

Figure 1:
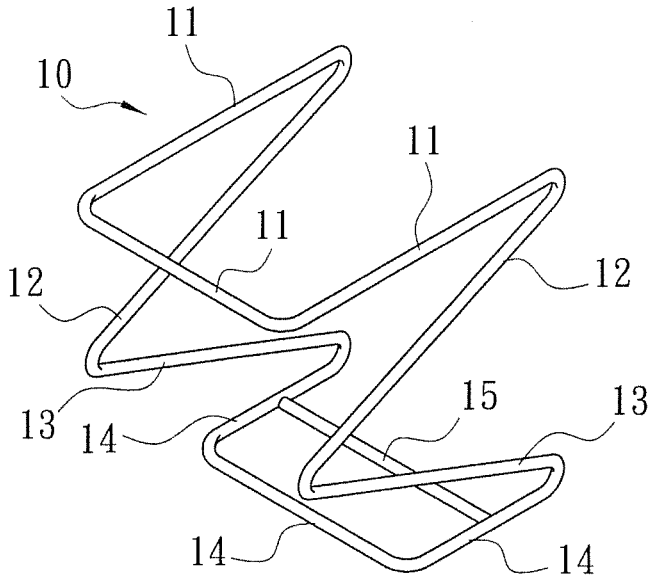
FIG. 1 is an elevational view of a storage rack in accordance with a first embodiment of the present invention.

Referring to FIG. 1, a storage rack 10 in accordance with a first embodiment of the present invention is made of metal wire rods, comprising a U-shaped top constraint rod 11, a U-shaped bottom positioning rod 14, two oblique upper side rods 12 respectively forwardly extended from the two distal ends of the U-shaped top constraint rod 11, two oblique lower side rods 13 respectively backwardly extended from the bottom ends of the two oblique upper side rods 12 and respectively connected to the two distal ends of the U-shaped bottom positioning rod 14, and a transverse rod 15 transversely connected between the two distal ends of the U-shaped bottom positioning rod 14 to reinforce the structural strength. According to this first embodiment, the U-shaped top constraint rod 11 and the U-shaped bottom positioning rod 14 are horizontally arranged at different elevations in a parallel manner.

Figure 2:
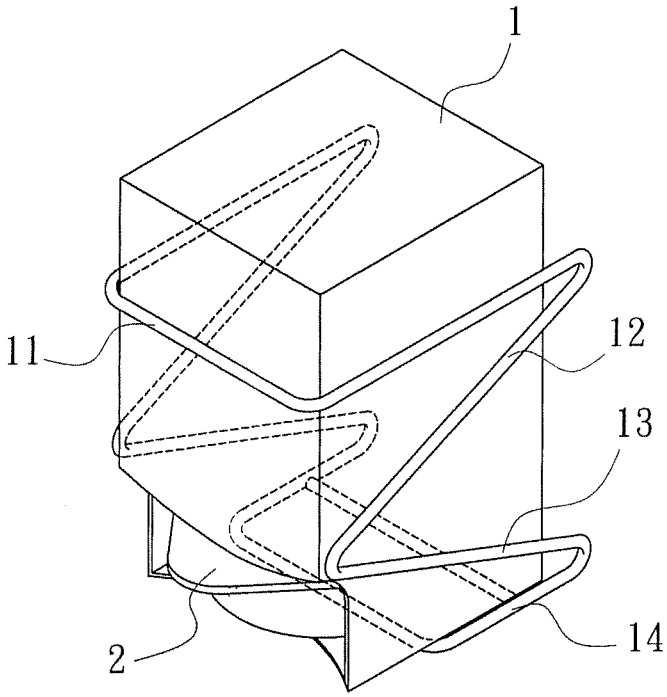
FIG. 2 is a perspective view illustrating an application example of the storage rack in accordance with the first embodiment of the present invention.

Referring to FIG. 2 and FIG. 1 again, a box 1 holding a stack of cap-like products 2 therein can be stored in the storage rack 10, enabling the oblique upper side rods 12 and the oblique lower side rods 13 to be clamped on the opposing left and right sides of the box 1 and the U-shaped top constraint rod 11 to be stopped at the front side of the box 1. When pulling one cap-like product 2 out of the box 1, the box 1 remains stored in the storage rack 10 stably.

Figure 3:
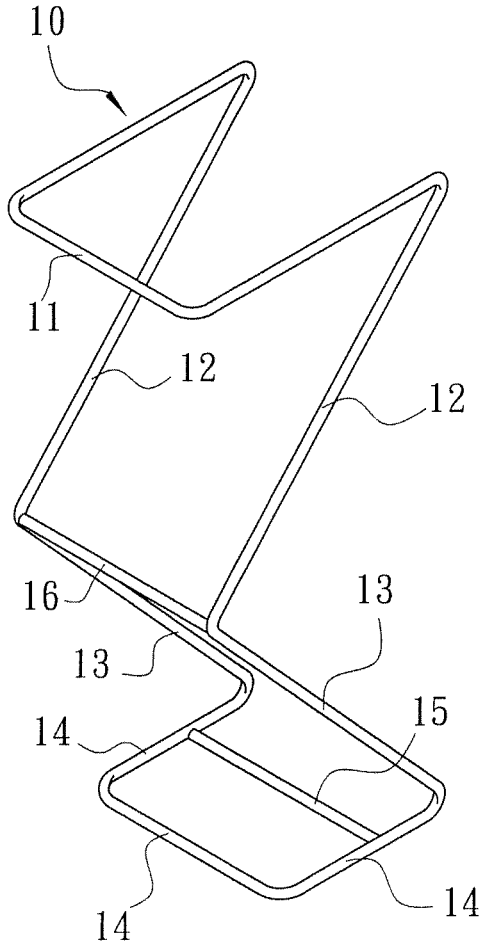
FIG. 3 is an elevational view of a storage rack in accordance with a second embodiment of the present invention.
Figure 4:
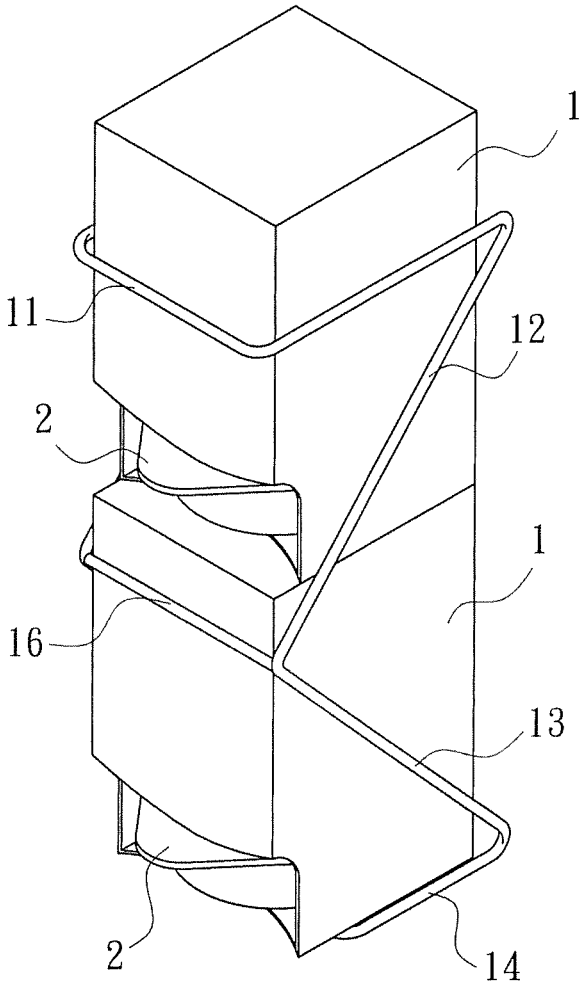
FIG. 4 is an elevational view illustrating an application example of the storage rack in accordance with the second embodiment of the present invention.

FIGS. 3 and 4 illustrate a storage rack 10 in accordance with a second embodiment. This second embodiment is substantially similar to the aforesaid first embodiment with the exception that the oblique upper side rods 12 are made relatively longer and an extra horizontal front bumper rod 16 is connected between the two connection areas between the oblique upper side rods 12 and the oblique lower side rods 13. This second embodiment is practical for holding two boxes 1 in a stack.

Figure 5:
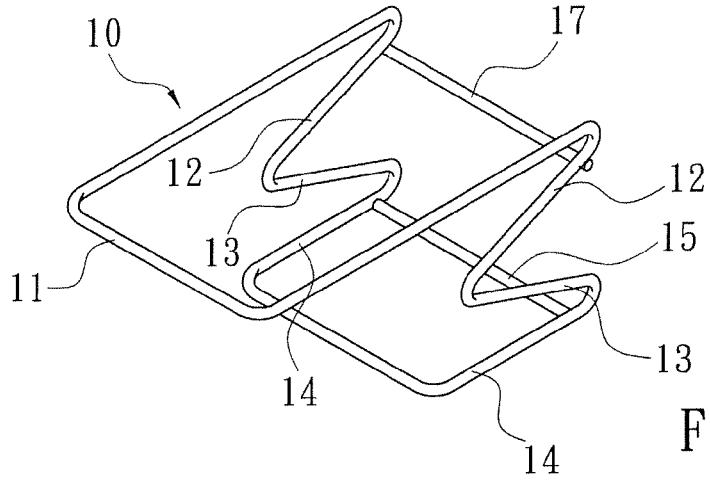
FIG. 5 is an elevational view of a storage rack in accordance with a third embodiment of the present invention.
Figure 6:
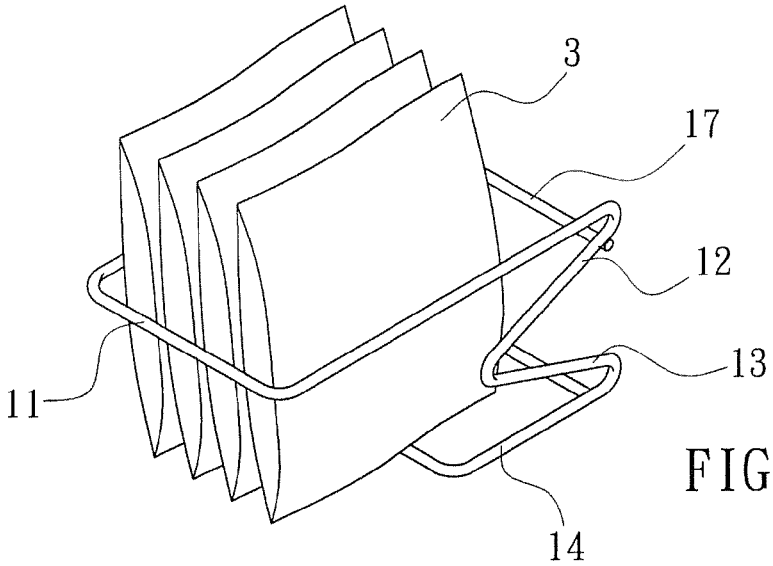
FIG. 6 is an elevational view illustrating an application example of the storage rack in accordance with the third embodiment of the present invention.

FIGS. 5 and 6 illustrate a storage rack 10 in accordance with a third embodiment. This third embodiment is substantially similar to the aforesaid first embodiment with the exception that the contained angle defined by the oblique upper side rods 12 and the oblique lower side rods 13 is relatively smaller so that the height of the storage rack 10 is relatively reduced. Further, an extra horizontal rear bumper rod 17 is connected between the two oblique upper side rods 12 near the U-shape top constraint rod 11. This third embodiment is practical for holding bags 3.

Figure 7:
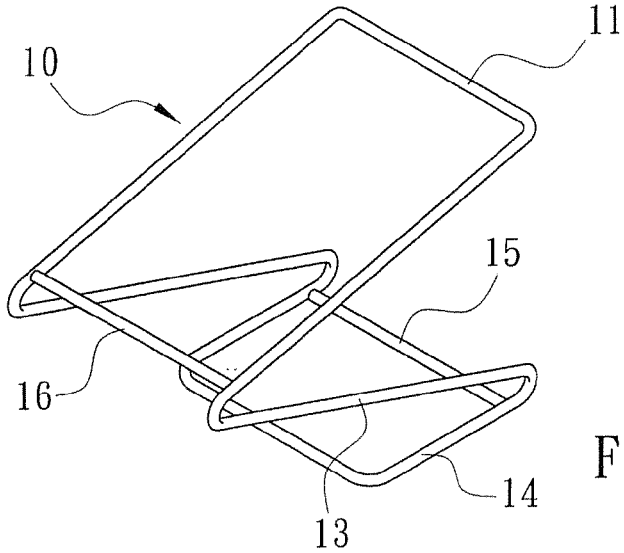
FIG. 7 is an elevational view of a storage rack in accordance with a fourth embodiment of the present invention.

FIG. 7 illustrates a storage rack 10 in accordance with a fourth embodiment. According to this fourth embodiment, the storage rack 10 comprises a U-shaped top constraint rod 11 sloping at a predetermined angle, a U-shaped bottom positioning rod 14, two oblique lower side rods 13 respectively between the two distal ends of the U-shaped top constraint rod 11 and the two distal ends of the U-shaped bottom positioning rod 14, a transverse rod 15 transversely connected between the two distal ends of the U-shaped bottom positioning rod 14 near the two oblique lower side rods 13 and a horizontal front bumper rod 16 connected between the two distal ends of the U-shaped top constraint rod 11 near the oblique lower side rods 13.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A storage rack, comprising a U-shaped top constraint rod extending forwardly a first distance, a U-shaped bottom positioning rod extending forwardly a second distance and forming a free standing base for the storage rack, two oblique upper side rods respectively forwardly extended from two distal ends of said U-shaped top constraint rod, two oblique lower side rods respectively backwardly extended from respective bottom ends of said two oblique upper side rods and respectively connected to two distal ends of said U-shaped bottom positioning rod, and a transverse rod transversely connected between the two distal ends of said U-shaped bottom positioning rod; said first distance being greater than said second distance and said oblique upper and lower side rods collectively maintaining said U-shaped top constraint rod suspended in an overhanging manner over said U-shaped bottom positioning rod, where said U-shaped top constraint rod is disposed in parallel relationship with said U-shaped bottom positioning rod.

* * * * *